US007946080B2

(12) United States Patent
Ellerton et al.

(10) Patent No.: US 7,946,080 B2
(45) Date of Patent: May 24, 2011

(54) LOCK ASSEMBLY

(75) Inventors: Todd Ellerton, Roscoe, IL (US); Markus E. Muller, Rockford, IL (US); Christopher C. Rindels, Rockford, IL (US)

(73) Assignee: Newell Operating Company, Atlanta, GA (US)

( * ) Notice: Subject to any disclaimer, the term of this patent is extended or adjusted under 35 U.S.C. 154(b) by 1066 days.

(21) Appl. No.: 11/668,239

(22) Filed: Jan. 29, 2007

(65) Prior Publication Data

US 2008/0178530 A1 Jul. 31, 2008

(51) Int. Cl.
*E05C 9/00* (2006.01)

(52) U.S. Cl. ..... 49/395; 292/32; 292/36; 292/42

(58) Field of Classification Search ..... 49/394, 49/395, 366, 367; 70/107–111; 292/32, 292/36, 38, 39, 42
See application file for complete search history.

(56) References Cited

U.S. PATENT DOCUMENTS

| | | | |
|---|---|---|---|
| 508,635 | A | 11/1893 | Reeves |
| 654,579 | A | 7/1900 | Ericson |
| 928,904 | A | 7/1909 | Cottrell |
| 1,094,143 | A | 4/1914 | Hagstrom |
| 1,311,598 | A | 7/1919 | Fink |
| 2,787,154 | A | 4/1957 | Wesberry |
| 2,886,960 | A | 5/1959 | Willett et al. |
| 3,086,383 | A | 4/1963 | Scott |
| 3,670,537 | A | 6/1972 | Horgan, Jr. |
| 3,680,901 | A | 8/1972 | Biebuyck |
| 3,697,105 | A | 10/1972 | Marx |
| 3,771,339 | A | 11/1973 | Smith |
| 3,811,717 | A | 5/1974 | Floyd et al. |
| 3,863,471 | A | 2/1975 | Keller-Volper |
| 3,930,390 | A | 1/1976 | Keller |
| 3,976,024 | A | 8/1976 | Fillery |
| 4,227,723 | A | 10/1980 | Rosell |
| 4,315,648 | A | 2/1982 | Labelle |
| 4,362,328 | A | 12/1982 | Tacheny et al. |
| 4,368,905 | A | 1/1983 | Hirschbein |
| 4,480,862 | A | 11/1984 | Fleming |
| 4,500,122 | A | 2/1985 | Douglas |
| 4,548,432 | A | 10/1985 | Bengtsson |
| 4,617,775 | A | 10/1986 | Padrun |
| 4,643,005 | A | 2/1987 | Logas |
| 4,648,639 | A | 3/1987 | Martin et al. |

(Continued)

FOREIGN PATENT DOCUMENTS

CA 2183501 C 2/1997

(Continued)

*Primary Examiner* — Jerry Redman
(74) *Attorney, Agent, or Firm* — Taft Stettinius & Hollister LLP

(57) ABSTRACT

A passive lock assembly is suitable for use with a door mounted to a door frame. The passive lock assembly includes a housing, a bolt, an actuator, and a stop member. The housing is mounted on the door. The bolt extends from the housing and is moveable between an extended position and a retracted position. The actuator is supported by the housing and is operably connected to the bolt. Additionally, the actuator is moveable to move the bolt between the extended position and the retracted position. The stop member is pivotably connected to the housing and pivotable between a first position and a second position. In the first position, the stop member engages an engagement surface of the actuator to obstruct movement of the actuator and prevent movement of the bolt to the retracted position, and in the second position, the stop member does not obstruct movement of the actuator.

21 Claims, 5 Drawing Sheets

U.S. PATENT DOCUMENTS 4,674,776 A 6/1987 James
4,754,624 A 7/1988 Fleming et al.
4,861,078 A 8/1989 Munoz
4,865,367 A 9/1989 Choi
4,907,908 A 3/1990 Gerhard
4,932,691 A 6/1990 White
4,936,613 A 6/1990 Aumercier
4,964,660 A 10/1990 Prevot et al.
4,973,091 A 11/1990 Paulson et al.
4,974,886 A 12/1990 Kleefeldt et al.
4,991,886 A 2/1991 Nolte et al.
5,042,851 A 8/1991 Hunt
5,044,184 A 9/1991 Herbers et al.
5,074,133 A 12/1991 Simoncelli
5,083,822 A 1/1992 Mangin et al.
5,096,237 A 3/1992 Hotzl
5,102,174 A 4/1992 Prevot
5,120,094 A 6/1992 Eaton et al.
5,172,944 A 12/1992 Munich et al.
5,197,771 A 3/1993 Kaup et al.
5,253,903 A 10/1993 Daley
5,290,077 A 3/1994 Fleming
5,371,991 A 12/1994 Bechtel et al.
5,373,716 A 12/1994 MacNeil et al.
5,388,875 A 2/1995 Fleming
5,394,718 A 3/1995 Hotzl
5,404,737 A 4/1995 Hotzl
5,419,597 A 5/1995 Brackmann et al.
5,440,103 A 8/1995 Martin
5,492,382 A 2/1996 McBride et al.
5,495,731 A 3/1996 Riznik
5,498,038 A 3/1996 Simon et al.
5,524,941 A 6/1996 Fleming
5,524,942 A 6/1996 Fleming
5,542,720 A 8/1996 Fleming
5,561,994 A 10/1996 Smith et al.
5,561,995 A 10/1996 Copping et al.
5,603,534 A 2/1997 Fuller
5,620,216 A 4/1997 Fuller
5,660,420 A 8/1997 Smith et al.
5,676,003 A 10/1997 Ursel et al.
5,688,000 A 11/1997 Dolman
5,722,704 A 3/1998 Chaput et al.
5,752,727 A 5/1998 Zeus et al.
5,782,114 A 7/1998 Zeus et al.
5,794,844 A 8/1998 Jenkins
5,806,353 A 9/1998 Pages
5,820,170 A 10/1998 Clancy
5,820,173 A 10/1998 Fuller
5,820,177 A 10/1998 Moon
5,822,926 A 10/1998 Koike et al.
5,829,802 A 11/1998 Anderson et al.
5,865,479 A 2/1999 Viney
5,873,274 A 2/1999 Sauerland
5,878,605 A 3/1999 Renz
5,878,606 A 3/1999 Chaput et al.
5,890,753 A 4/1999 Fuller
5,901,989 A 5/1999 Becken et al.
5,906,403 A 5/1999 Bestler et al.
5,911,763 A 6/1999 Quesada
6,007,114 A 12/1999 Hotzl
6,007,115 A 12/1999 Roth
6,048,000 A 4/2000 Geringer et al.
6,109,666 A 8/2000 Collet
6,174,004 B1 1/2001 Picard et al.
6,209,364 B1 4/2001 Collet et al.
6,209,931 B1 4/2001 Von Stoutenborough et al.
6,217,087 B1 4/2001 Fuller
6,230,457 B1 5/2001 Brautigam
6,250,119 B1 6/2001 Flon
6,257,030 B1 7/2001 Davis, III et al.
6,264,252 B1 7/2001 Clancy
6,282,929 B1 9/2001 Eller et al.
6,283,516 B1 9/2001 Viney
6,289,704 B1 9/2001 Collet et al.
6,324,876 B1 12/2001 Prevot et al.
6,357,803 B1 3/2002 Lorek
6,375,244 B1 4/2002 Smeltzer
6,378,916 B1 4/2002 Huang
6,409,231 B1 6/2002 Rusiana
6,415,565 B1 7/2002 Sosa
6,478,345 B1 11/2002 Viney
6,508,087 B2 1/2003 Lemley et al.
6,539,755 B1 4/2003 Bruwer et al.
6,592,155 B1 7/2003 Lemley et al.
6,637,784 B1 10/2003 Hauber et al.
6,641,182 B2 11/2003 Schlack et al.
6,688,656 B1 2/2004 Becken
6,698,970 B2 3/2004 Guillermet et al.
6,767,038 B1 7/2004 Huml
6,810,699 B2 11/2004 Nagy
6,871,451 B2 3/2005 Harger et al.
6,883,837 B1 4/2005 Lin
6,907,830 B2 6/2005 Guinan et al.
6,929,293 B2 8/2005 Tonges
6,935,662 B1 8/2005 Hauber et al.
6,962,377 B2 11/2005 Tonges
6,963,266 B2 11/2005 Palomaki et al.
6,971,686 B2 12/2005 Becken
6,981,724 B2 1/2006 Denys
7,013,688 B2 3/2006 Chen
7,025,394 B1 4/2006 Hunt
2002/0104339 A1 8/2002 Saner
2005/0092042 A1 5/2005 Constantinou et al.
2005/0103066 A1 5/2005 Botha et al.
2005/0166647 A1 8/2005 Walls et al.
2005/0229657 A1 10/2005 Johansson et al.
2006/0196236 A1 9/2006 Gruenendahl
2007/0080541 A1 4/2007 Fleming
2007/0170725 A1 7/2007 Speyer et al.

FOREIGN PATENT DOCUMENTS

CA 2221223 C 11/1998
CA 2365157 A1 11/1998
CA 2254164 6/1999
CA 2426191 A1 4/2002
EP 0909863 B1 4/1999
EP 0974721 B1 1/2000
EP 0974722 B1 1/2000
EP 0987387 B1 3/2000
EP 0995862 B1 4/2000
EP 1001122 B1 5/2000
EP 1030018 B1 8/2000
EP 1085150 B1 3/2001
EP 1091064 B1 4/2001
EP 1098057 B1 5/2001
EP 1213426 B1 6/2002
WO 0233202 A3 4/2002

LOCK ASSEMBLY

CROSS-REFERENCE TO RELATED APPLICATIONS

None.

FEDERALLY SPONSORED RESEARCH OR DEVELOPMENT

None.

TECHNICAL FIELD

The invention relates to lock assemblies, and, more specifically, to a passive lock assembly for use with dual-hung swinging doors.

BACKGROUND OF THE INVENTION

Lock assemblies and systems for locking doors are widely known and used. FIG. 1 illustrates a multi-point door locking system 1, operatively connected to a conventional swinging door assembly 12, such as a French door assembly. The door assembly 12 generally comprises a primary, or active, door member 14, and a secondary, or passive, door member 16, mounted within a master door frame 18. The active door 14 is generally adapted for reciprocal sliding and/or swinging movement within the door frame 18, thereby enabling ingress and egress through the door assembly 12. Generally, the passive door 16 is also a movable member capable of sliding and/or swinging within the door frame 18. The active door 14 and passive door 16 are preferably mounted in side-by-side relation to each other, and each door 14,16 has a confronting face 22,24 confronting the other door 14,16. The locking system 1 generally includes an active lock 3 on the active door 14 and a passive lock 4 on the passive door 16. The passive lock 4 generally contains shoot bolts that engage the door frame at the top and bottom of the door 16 to lock the door 16 to the frame 18. The active lock 3 generally also contains shoot bolts that engage the door frame 18, as well as a latch bolt and a dead bolt that extend into the passive door 16 to lock the doors 14,16 together. Thus, by design, the passive door 16 is not intended to be opened unless and until the active door is opened, or at least has withdrawn the latch bolt and dead bolt locking the doors together.

However, prior art multi-point locking systems provide certain disadvantages. For example, prior locking systems often experience problems with controlling the locking and unlocking of the passive lock 4 when the active lock 3 is still locking the active door 14 to the passive door 16. Unlocking and/or opening the passive door 14 at such a time could cause damage to the active door 14, the passive door 16, or the locking mechanisms 3,4. The present invention is provided to solve the problems discussed above and other problems, and to provide advantages and aspects not provided by prior locking systems of this type. A full discussion of the features and advantages of the present invention is deferred to the following detailed description, which proceeds with reference to the accompanying drawings.

SUMMARY OF THE INVENTION

The present invention provides a passive lock assembly suitable for use with a door mounted to a door frame and moveable between an open position and a closed position. The passive lock assembly includes a housing, a receiver, a bolt, an actuator, and a stop member. The housing is mounted on the door, and the receiver is mounted on the door frame. The bolt extends from the housing and is moveable between an extended position, where the bolt engages the receiver to lock the door in the closed position, and a retracted position, where the bolt retracts from the receiver to permit the door to move to the open position. The actuator is supported by the housing and is operably connected to the bolt. Additionally, the actuator is moveable to move the bolt between the extended position and the retracted position. The stop member is pivotably connected to the housing and pivotable between a first position and a second position. In the first position, the stop member engages an engagement surface of the actuator to obstruct movement of the actuator and prevent movement of the bolt to the retracted position, and in the second position, the stop member does not obstruct movement of the actuator.

According to one aspect of the invention, the stop member is elongated along an axis substantially normal to the engagement surface of the actuator.

According to another aspect of the invention, the stop member has an engagement member extending substantially normal to the axis of elongation of the stop member, the engagement member adapted to be engaged by a latch bolt extending into the housing to move the stop member from the second position to the first position.

According to another aspect of the invention, the stop member is substantially normal to the engagement surface of the actuator when in the first position.

According to another aspect of the invention, the stop member has first and second opposed ends and is pivotably connected to the housing at the first end and engages the actuator at the second end. The stop member is tapered inward proximate the second end.

According to another aspect of the invention, the actuator is pivotably connected to the housing, and the passive lock assembly further includes a handle connected to the actuator. The handle is adapted to be manipulated by a user to pivotably move the actuator.

According to another aspect of the invention, the stop member is adapted to be engaged by a latch bolt extending into the housing to move the stop member from the second position to the first position.

According to another aspect of the invention, the passive lock assembly also includes means for biasing the stop member to the second position and means for biasing the actuator toward a central position.

According to another aspect of the invention, the passive lock assembly also includes a retraction member supported by the housing and operably connected to the bolt for moving the bolt between the extended position and the retracted position. The actuator engages the retraction member to move the bolt.

According to another aspect of the invention, the passive lock assembly also includes a second receiver adapted to be mounted on the door frame, on a side of the door frame opposite the first receiver and a second bolt extending from the housing in a direction opposite the direction of the first bolt. The second bolt is moveable between an extended position and a retracted position. In the extended position, the second bolt engages the second receiver to lock the door in the closed position, and in the retracted position, the second bolt retracts from the second receiver to permit the door to move to the open position The actuator is operably connected to the second bolt, and the actuator is moveable to move the first bolt and the second bolt simultaneously between the extended positions and the retracted positions.

According to another aspect of the invention, the passive lock assembly also includes a first retraction member and a second retraction member. The first retraction member is supported by the housing and operably connected to the first bolt for moving the first bolt between the extended position and the retracted position. The second retraction member is supported by the housing and operably connected to the second bolt for moving the second bolt between the extended position and the retracted position. The actuator engages the first retraction member to move the first bolt, and the first retraction member is operably connected to the second retraction member to move the second bolt.

According to another aspect of the invention, the actuator includes a body and an arm extending from the body. The arm has an offset portion, and the engagement surface is located on the offset portion of the arm.

The present invention also provides a door assembly including a door frame, an active door and a passive door mounted within the door frame in side-by-side relation, an active lock assembly mounted within the active door, a receiver mounted in the door frame, and a passive lock assembly mounted within the passive door. The active door and the passive door are each moveable between an open position and a closed position. The active lock includes a latch bolt moveable between an extended position and a retracted position, and a handle operably coupled to the latch bolt to move the latch bolt between the extended position and the retracted position. The passive lock assembly includes a housing, a shoot bolt, a retraction member, an actuator, a handle, a stop member, and two spring members. The housing is mounted within the passive door and has a face plate having an aperture therein. The shoot bolt extends from the housing and is moveable between an extended position and a retracted position. The retraction member is supported by the housing and is operably connected to the shoot bolt for moving the shoot bolt between the extended position and the retracted position. The actuator is supported by the housing and is operably connected to the retraction member. The actuator is moveable to move the shoot bolt between the extended position and the retracted position. The handle is coupled to the actuator and adapted to be manipulated by a user to move the actuator. One spring member is coupled to the actuator to bias the actuator to a central position. The stop member is pivotably connected to the housing and pivotable between a first position and a second position. In the first position, the stop member engages an engagement surface of the actuator to obstruct movement of the actuator and prevent movement of the shoot bolt to the retracted position, and in the second position, the stop member does not obstruct movement of the actuator. The stop member is substantially normal to the engagement surface when in the first position. The other spring member is coupled to the stop member to bias the stop member toward the second position. When the active door and the passive door are in the closed positions and the latch bolt is in the extended position, the latch bolt extends into the housing and engages the stop member to move the stop member from the second position to the first position.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
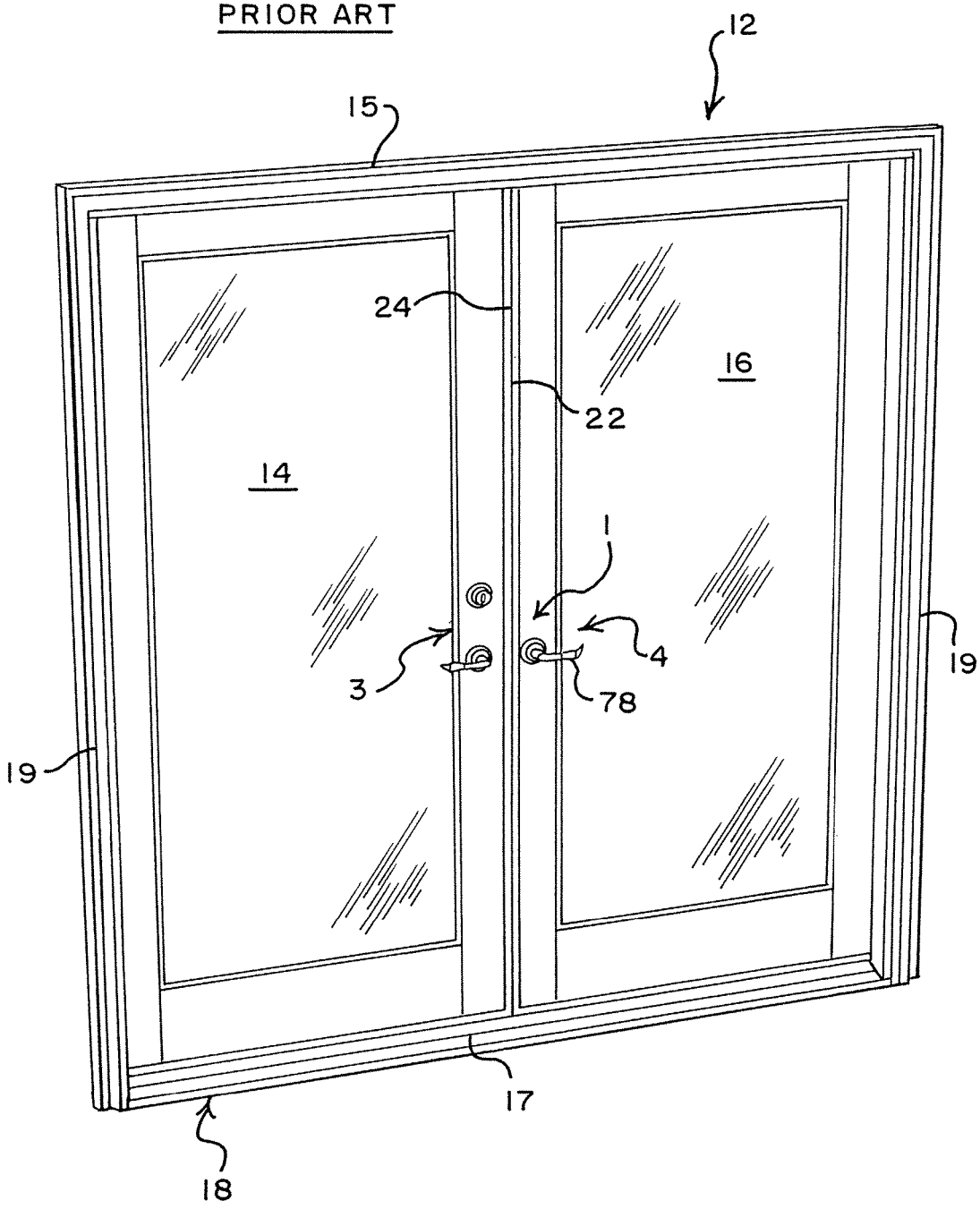
FIG. 1 PRIOR ART
FIG. 1 is a perspective view of an embodiment of a prior art door assembly having a multi-point locking system.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
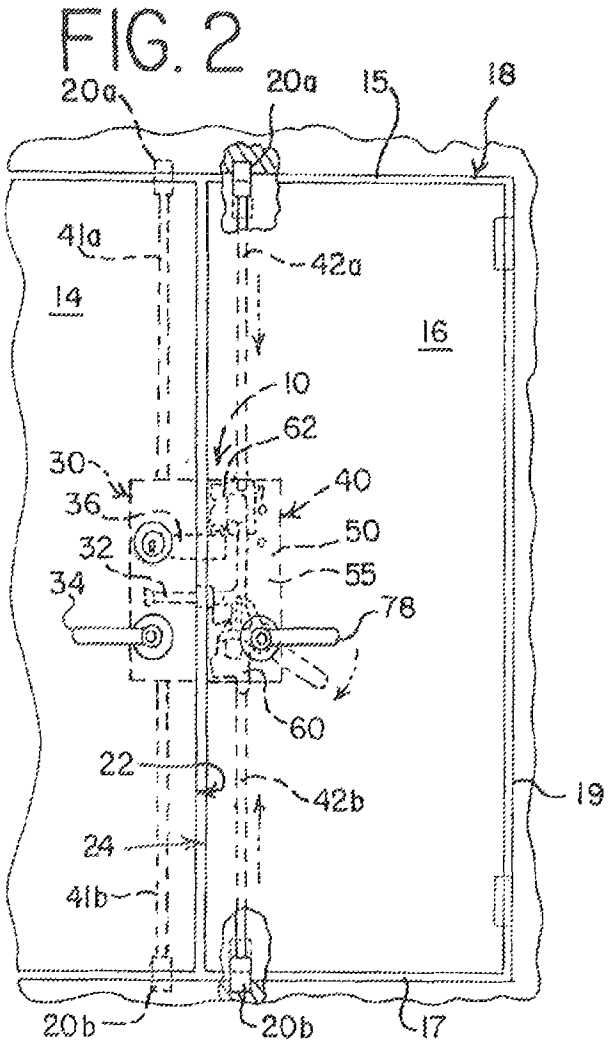
FIG. 2 is an elevation view of a door assembly showing a schematic view of a multi-point locking system of the present invention.

Referring now to FIG. 2, there is shown a multi-point door locking system 10 of the present invention, operatively connected to a conventional swinging door assembly 12, such as a French door assembly, as shown in FIG. 1. The door assembly 12 generally comprises a primary door member 14 or active member, and a passive door member 16 or passive member, mounted within a master door frame 18. The active door 14 is generally adapted for reciprocal sliding and/or swinging movement within the door frame 18, thereby enabling ingress and egress through the door assembly 12. In this embodiment, the passive door 16 also a movable member capable of sliding and/or swinging within the door frame 18. However, the passive door 16 may alternately be fixed to the door frame 18. The active door 14 and passive door 16 are preferably mounted in side-by-side relation to each other, and each door 14,16 has a confronting face 22,24 confronting the other door 14,16. The door frame 18 generally includes a top jamb or member 15 and a bottom jamb or member 17 extending between two side jambs 19.

As shown, the door frame 18 generally has one or more openings or receivers 20 formed within the top jamb 15 and the bottom jamb 17 for enabling locking engagement with the multi-point locking system 10. As shown, the system 10 is mounted within the door members 14,16 and the door frame 18. As shown, a first pair of receivers 20*a* is formed in the top jamb 15 of the frame 18 for providing receivable engagement with a first portion of the locking system 10. Additionally, a second pair of receivers 20*b* is formed in a lower portion of the frame 18 for receivable engagement with a second portion of the locking system 10.

The multi-point locking system 10 includes an active lock assembly 30 on the active door 14 and a passive lock assembly 40 on the passive door 16. The active lock 30 is mounted within the active door 14, proximate the confronting face 22 of the active door 14. The active lock 30 includes a latch bolt 32 that is moveable between an extended position, where the latch bolt 32 projects beyond the confronting face 22 of the door 14 and engages a structure on the passive door 16, and a retracted position, where the latch bolt 32 is drawn backward behind the confronting face 22 of the door and does not engage the structure on the passive door 16. Additionally, the active lock 30 includes an handle 34 operably connected to the latch bolt 32 to move the latch bolt 32 between the extended and retracted positions, and a biasing means for biasing the latch bolt 32 to the extended position. The active lock 30 may also include a retractable dead bolt 36 that is moveable between extended and retracted positions, like the latch bolt 32, as well as shoot bolts 41 that engage receivers 20*a*,20*b* in the door frame 18, as shown in FIG. 2.

Figure 7:
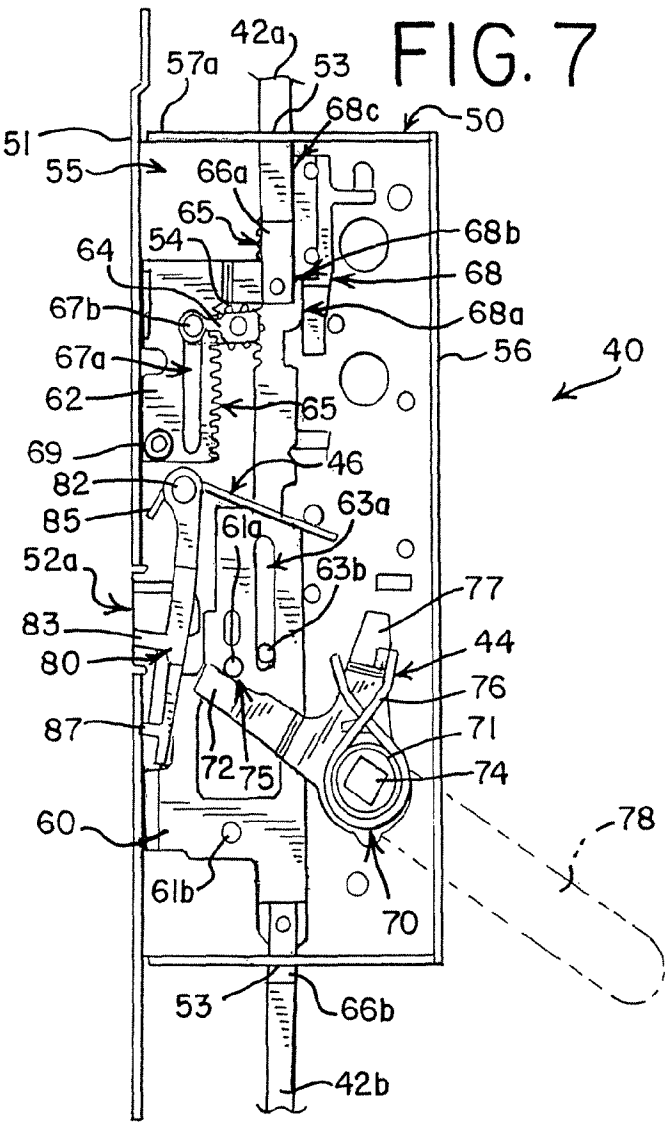
FIG. 7 is a front elevation view of the passive lock assembly of FIG. 4 in an unlocked configuration.

A preferred embodiment of the passive lock 40 is illustrated in FIGS. 4-7. The passive lock 40 is mounted within the passive door 16, proximate the confronting face 24 of the door 16. The passive lock 40 includes a housing 50, two shoot bolts 42 extending from the housing 50, two retraction members 60,62 connected to the shoot bolts 42, an actuator 70 operably connected to one of the retraction members 60, a handle 78 coupled to the actuator 70, a first biasing means 44 coupled to the actuator 70, a stop member 80, and a second biasing means 46 coupled to the stop member 80. The passive lock 40 is generally adjustable between a locked configuration (FIG. 4), a movable configuration (FIG. 6), and an unlocked configuration (FIG. 7). The components, assembly, and operation of the passive lock 40 are described in greater detail below.

Figure 5:
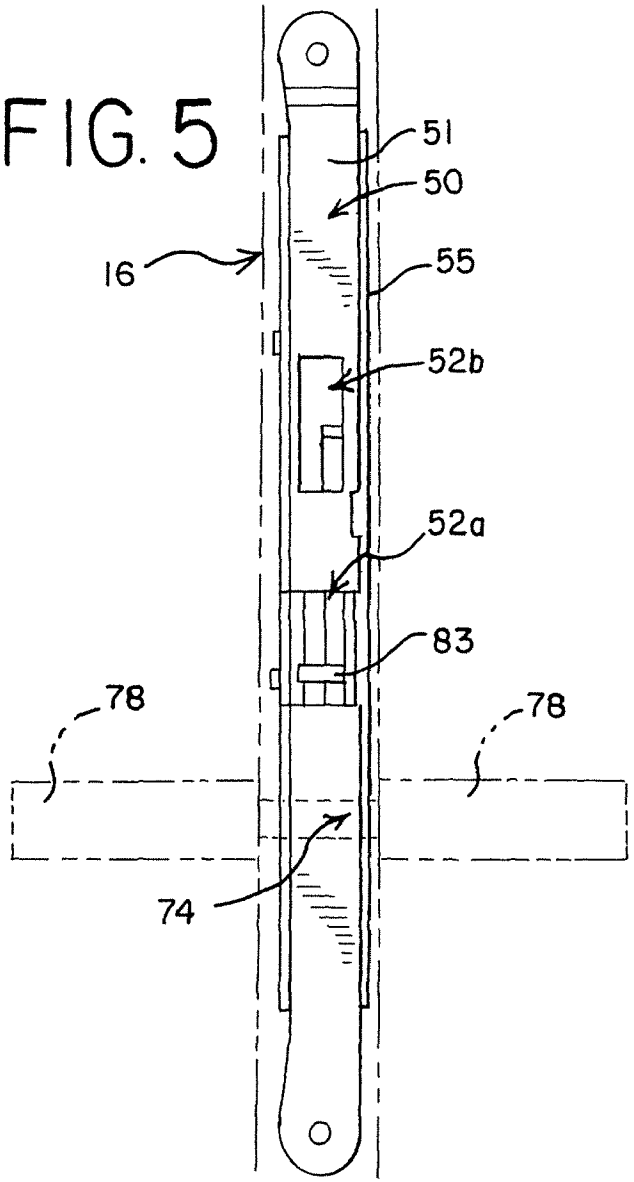
FIG. 5 is a side view of the passive lock assembly of FIG. 4.

The housing 50 generally contains and/or supports most other components of the passive lock 40, and is preferably a rectangular box made from stainless steel, having several openings therein. The housing 50 has a face plate 51, two large rectangular side walls 55, a back wall 56, a top end wall 57*a*, and a bottom end wall 57*b*. In a preferred embodiment, the entire housing 50 is one integral piece, except for one of the side walls 55, which is separate from the rest of the housing 50 and connected by fasteners to facilitate assembly of the passive lock 40. The face plate 51 is adapted to be securely connected to the door 16, such as by insertion of screws or other fasteners through holes in the face plate 51, or other known means of connection. The face plate 51 of the housing also preferably has two apertures 52 therein, as shown in FIG. 5. A latch bolt aperture 52*a* is adapted to allow the latch bolt 32 to extend into the housing 50, locking the active door 14 and the passive door 16 together. Similarly, a dead bolt aperture 52*b* is adapted to allow the dead bolt 36 to extend into the housing 50, more securely locking the active door 14 and the passive door 16 together. The housing 50 also has shoot bolt apertures 53 on the top and bottom end walls 57 of the housing 50, which provide access to the housing 50 for the shoot bolts 42 to connect to the retraction members 60,62 and/or other operating components of the passive lock 40 contained within the housing 50. Further, the housing 50 has several other pins, holes, and other connective structure for purposes such as mounting the housing 50 within the door 16 and for connecting other components of the passive lock 40 to the housing 50, some of which are described in greater detail below.

Two shoot bolts 42 extend from the top and bottom of the housing 50, as shown in FIGS. 2 and 4-7. The shoot bolts 42 are preferably elongated stainless steel bolts having a square or rectangular cross-section, and have a threaded section at one end for threaded connection to the connectors 66. Each shoot bolt 42 is moveable between an extended position and a retracted position, shown in FIG. 2. In the extended position, each shoot bolt 42 engages one of the receivers 20 at either the top or bottom of the door frame 18 to lock the passive door 16 in the closed position. In the retracted position, each shoot bolt 42 retracts from the respective receiver 20 to permit the passive door 16 to move to the open position. The shoot bolts 42 are moved between the extended position and the retracted position by movement of the actuator 70 by manipulation of the handle 78, which causes the retraction members 60,62 to move and retract or extend the shoot bolts 42. The operation of the shoot bolts 42 is described in greater detail below.

The passive lock 40 preferably contains two retraction members 60,62 contained within the housing 50. In a preferred embodiment, illustrated in FIGS. 4-7, the passive lock 40 has a first, "active" retraction member 60 and a second, "passive" retraction member 62. The retraction members 60,62 are operably connected to the actuator 70 and one of the shoot bolts 42, so that movement of the actuator 70 causes the retraction members 60,62 to move, extending and retracting the shoot bolts 42. In the embodiment shown in FIGS. 4-7, the first retraction member 60 is larger and is constructed of an elongated zinc-plated cold rolled steel plate that is cut or machined to include functional features. The first retraction member 60 preferably has two engagement pins 61 that are alternately engaged by an arm 72 of the actuator 70 to move the retraction member 60 in retracting and extending directions, to respectively retract and extend the shoot bolt 42. The first retraction member 60 also has a guide slot 63*a* therein, and a guide pin 63*b* connected to the housing 50 is received in the guide slot 63*a* to guide the first retraction member 60 in linear movement. The first retraction member 60 preferably slides along a side wall 55 of the housing 50, and is pinned against the side wall 55 at one end by the arm 72 of the actuator 70 and at the other end by a retainer 64. Further, the first retraction member 60 preferably has a toothed edge or surface 65 at one end and a connector 66 at the other end. The connector 66*b* is adapted for connection to the shoot bolt 42*b*, and preferably contains a threaded cavity for connection with a threaded end of the shoot bolt 42*b*. The first retraction member 60 is preferably pivotably coupled to the connector 66*b* via a pin connection. In other embodiments, the first retraction member 60 may have a different configuration and may be made of another suitable material.

In the embodiment shown in FIGS. 4-7, the second retraction member 62 is smaller and constructed of a zinc-plated cold rolled steel plate that is cut or machined to include functional features. Like the first retraction member 60, the second retraction member 62 has a guide slot 67*a* therein, and a guide pin 67*b* connected to the housing 50 is received in the guide slot 67*a* to guide the second retraction member 62 in linear movement. Also like the first retraction member 60, the second retraction member 62 preferably slides along the side wall 55 of the housing 50, and is pinned against the side wall 55 by the retainer 64. Further, the second retraction member 62 has a toothed edge or surface 65 at one end and a connector 66*a* at the other end for connection to the shoot bolt 42*a*. The connector 66*a* of the second retraction member 62 is preferably identical in form, connection, and function as the connector 66*b* of the first retraction member 60. The second retraction member 62 also preferably has a bumper 69 on the end for abutting the dead bolt 36 when the dead bolt 36 is received in the housing 50, as described below.

The second retraction member 62 is operably connected to the first retraction member 60, such that the second retraction member 62 moves in response to the movement of the first retraction member 60 to move the second retraction member 62 in retracting and extending directions, to respectively retract and extend the shoot bolt 42. In the embodiment shown in FIGS. 4-7, a toothed sprocket 54 is rotatably mounted on to the side wall 55 of the housing and engages the toothed edges 65 of the retraction members 60,62. The movement of the first retraction member 60 (in response to movement of the actuator 70) causes the sprocket 54 to rotate, which in turn moves the second retraction member 62 in the opposite direction as the first retraction member 60. Thus, the retraction members 60,62 move simultaneously to retract or extend the shoot bolts 42, but move in opposing directions.

A plastic guide 68 is preferably mounted within the housing 50 to guide the movement of the retraction members 60,62. The guide 68 has a guide surface 68*a* and a first slot 68*b* for guiding the movement of the first retraction member 60, wherein a portion of the first retraction member 60 slides along the guide surface 68*a* and is received in the first slot 68*b*. The guide 68 also has a second slot 68*c* for guiding the movement of the second retraction member 62, wherein a portion of the second retraction member 62 is received in the second slot 68*c*.

A preferred embodiment of the actuator 70 is shown in FIGS. 4-7 and 9-10, and contains a body 71, an arm 72 extending from the body 71, and a biasing means 44. The actuator 70 is preferably rotatably supported by the housing 50 and is operably connected to the first retraction member 60, as described above, to move the shoot bolts 42 between the extended positions and the retracted positions. The actuator body 71 preferably is rotatably mounted within opposing holes in the side walls 55 of the housing 50, and has a square aperture 74 extending completely through the actuator 70. The aperture 74 is accessible from outside the housing 50, from either side of the housing 50. The actuator arm 72 preferably has an engagement surface 75 thereon, for engaging the stop member 80, as described below. The engagement surface 75 may be located on a different portion of the actuator 70, depending on the configuration of the stop member 80. The arm 72 also engages one or the other of the engagement pins 61 on the first retraction member 60, such that rotation of the actuator 70 causes the first retraction member 60 to move, as illustrated by the broken lines in FIGS. 4-5.

Figure 10:
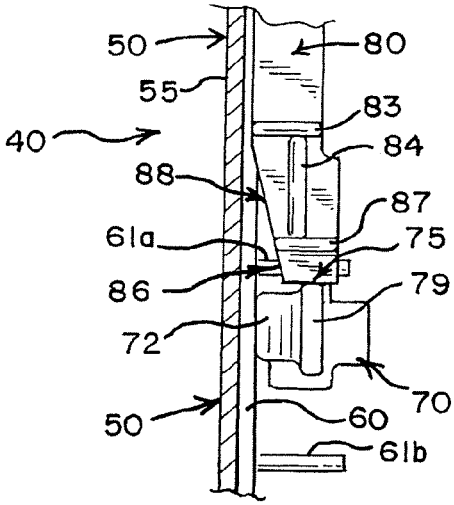
FIG. 10 is a focused side view of a stop member and actuator of the passive lock assembly of FIG. 4 in the locked configuration.

As illustrated in FIG. 7, the actuator arm 72 has a stepped or offset portion 79 that is offset from the remainder of the actuator arm 72. In this embodiment, the engagement surface 75 is located on the offset portion 79 of the actuator arm 72. The offset portion 79 ensures that the actuator arm 72 contacts the stop member 80 about the midpoint of the free end 86 of the stop member 80, as illustrated in FIG. 10, offering more direct and balanced engagement with the stop member 80. This centered engagement decreases the likelihood that the actuator arm 72 could work its way past the stop member 80. The engagement pins of prior lock assemblies often have a bushing on the top of each pin to engage and "trap" the actuator arm when the arm contacts the pin. In one embodiment, the passive lock assembly 40 has taller engagement pins 61 that have no bushings, to cooperate more effectively with the stepped configuration of the actuator arm 72.

In a preferred embodiment, the biasing means 44 contains a spring member 76 wound around the body 71 and a spring-engaging member 77 extending from the body 71. The spring-engaging member 77 engages the spring 76 to bias the actuator 70 toward a central position and resists rotation of the actuator 70 in either direction. The biasing means 44 may have any other suitable configuration, such as a differently-configured spring or another type of spring.

A handle 78 is coupled to the actuator 70 and adapted to be manipulated by a user to move the actuator 70. Preferably, a portion of the handle 78 is received in the aperture 74 in the actuator body 71 and engages the inner surfaces of the aperture 74 to rotate the actuator 70. Additionally, the handle 78 preferably extends completely through the actuator 70 and the housing 50 and is accessible to open the door 16 from either side. From the view shown in FIGS. 4 and 6-7, the handle 78 and actuator 70 are rotated clockwise to move the shoot bolts 42 to the retracted positions and counterclockwise to move the shoot bolts 42 to the extended positions.

Figure 4:
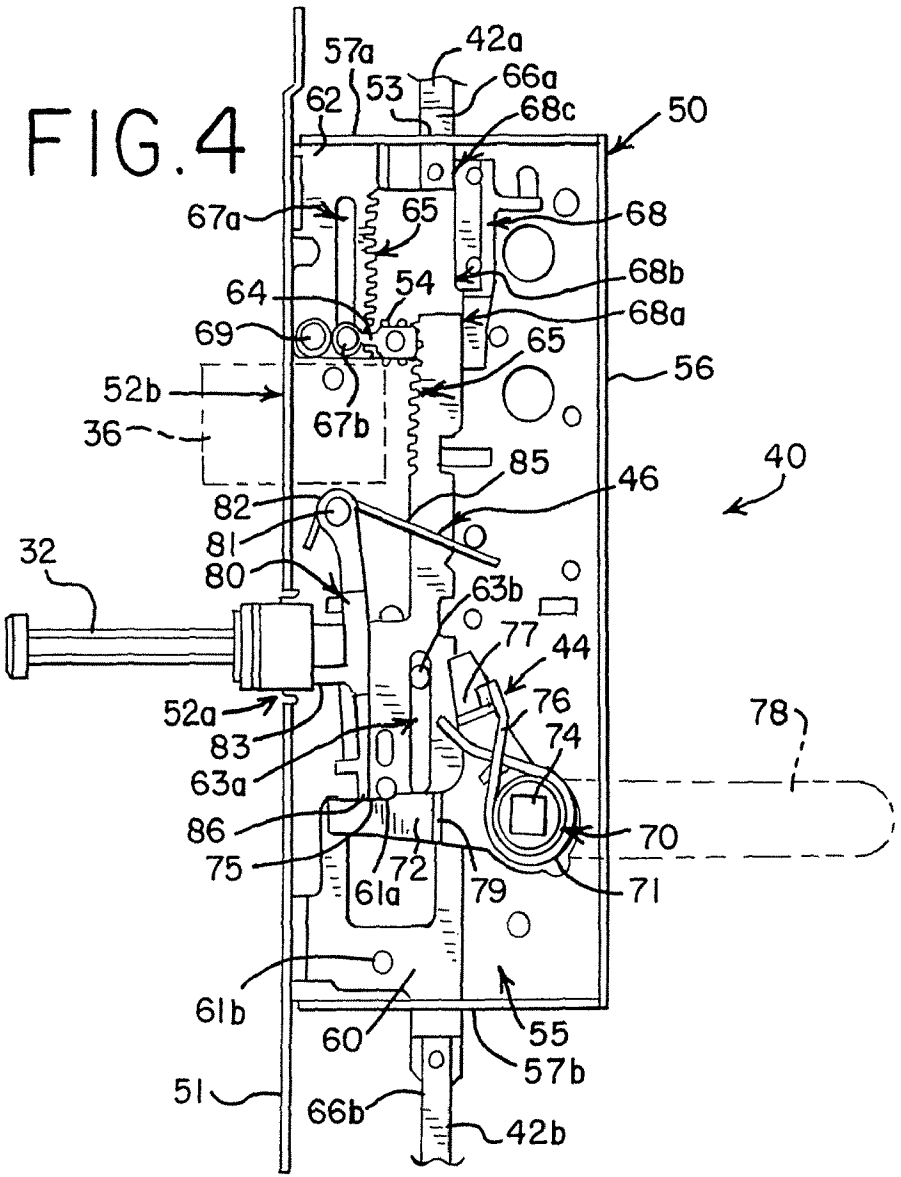
FIG. 4 is a front elevation view of one embodiment of a passive lock assembly of the present invention in a locked configuration.
Figure 8:
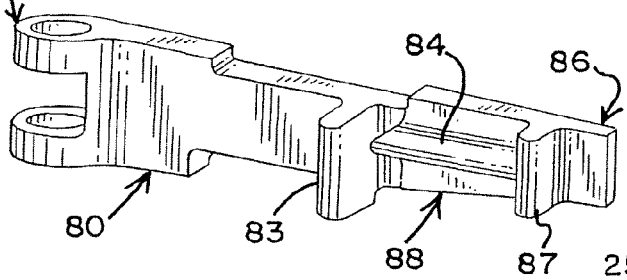
FIG. 8 is a perspective view of a stop member of the passive lock assembly of FIG. 3.
Figure 9:
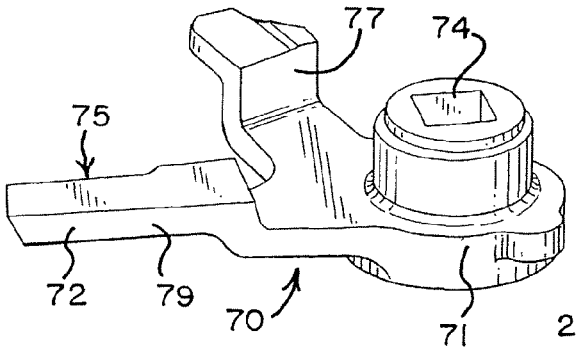
FIG. 9 is a perspective view of an actuator of the passive lock assembly of FIG. 4.

A preferred embodiment of the stop member 80 is shown in FIGS. 8 and 10. Preferably, the stop member 80 is made from 50% glass-filled nylon for strength and cost efficiency, but the stop member 80 may be made from other suitable materials, such as metal or other polymers or composites. The stop member 80 is supported by the housing 50 and moveable between a first position and a second position. In the first position, shown in FIG. 4, the stop member 80 engages the engagement surface 75 of the actuator 70 to obstruct movement of the actuator 70 and prevent movement of the shoot bolts 42 to the retracted positions. Preferably, the stop member 80 engages the engagement surface 75 such that the stop member 80 is substantially normal (perpendicular) to the engagement surface 75. Also, in the first position, the stop member 80 may engage the engagement pin 61*a*, preventing the stop member 80 from moving too far in that direction. In the second position, shown in FIGS. 6-7, the stop member 80 does not obstruct movement of the actuator. As shown in FIGS. 4 and 10, the stop member 80 is elongated along an axis that is substantially normal to the engagement surface 75 of the actuator 70 when the stop member 80 engages the actuator 70. In a preferred embodiment, the stop member 80 is pivotable, and is pivotably connected to the housing 50 by a pivot pin 81 (FIG. 4) at a first end, or fixed end 82. A second end, or free end 86 of the stop member 80 engages the actuator 70.

Additionally, when the latch bolt 32 associated with the active door 14 is received in the housing 50, the latch bolt 32 engages the stop member 80 to move the stop member 80 from the second position to the first position. In a preferred embodiment, the stop member 80 has an engagement member 83 extending substantially normal to the axis of elongation of the stop member 80. The engagement member 83 is adapted to be engaged by the latch bolt 32 to move the stop member from the second position to the first position, as illustrated in FIG. 4. When the stop member 80 is in the first position, the engagement member 83 extends to the edge of the housing 50 at the latch bolt aperture 52*a* (FIG. 6), so that any small intrusion of the latch bolt 32 into the housing 50 will abut the engagement member 83 and actuate the stop member 80. Further, the stop member 80 includes a strengthening rib 84 to add strength and rigidity to the free end 86 of the stop member 80 and a rest portion 87 for abutting the inner surface of the housing face plate 51 when the stop member 80 is in the second position, as shown in FIGS. 6-8 and 10.

As shown in FIG. 10, the stop member 80 is preferably tapered proximate the free end 86, and thus contains a tapered portion 88. In prior lock assemblies, such as the lock assembly 140 in FIG. 3, the actuator arm 172 is flat and holds the retraction member 160 in place against the wall of the housing 150. However, due to the stepped configuration of the actuator arm 72 of the passive lock assembly 40, the actuator arm 72 allows some shifting of the retraction member 60. The tapered design of the free end 86 prevents the retraction member 60 from contacting the stop member 80 and blocking movement of the stop member 80 if such shifting occurs. Preferably, the degree of taper of the stop member 80 is sufficient to prevent undesirable contact with the retraction member 60, but gradual enough that the actuator arm 72 still contacts the stop member proximate the midpoint of the free end 86.

Figure 6:
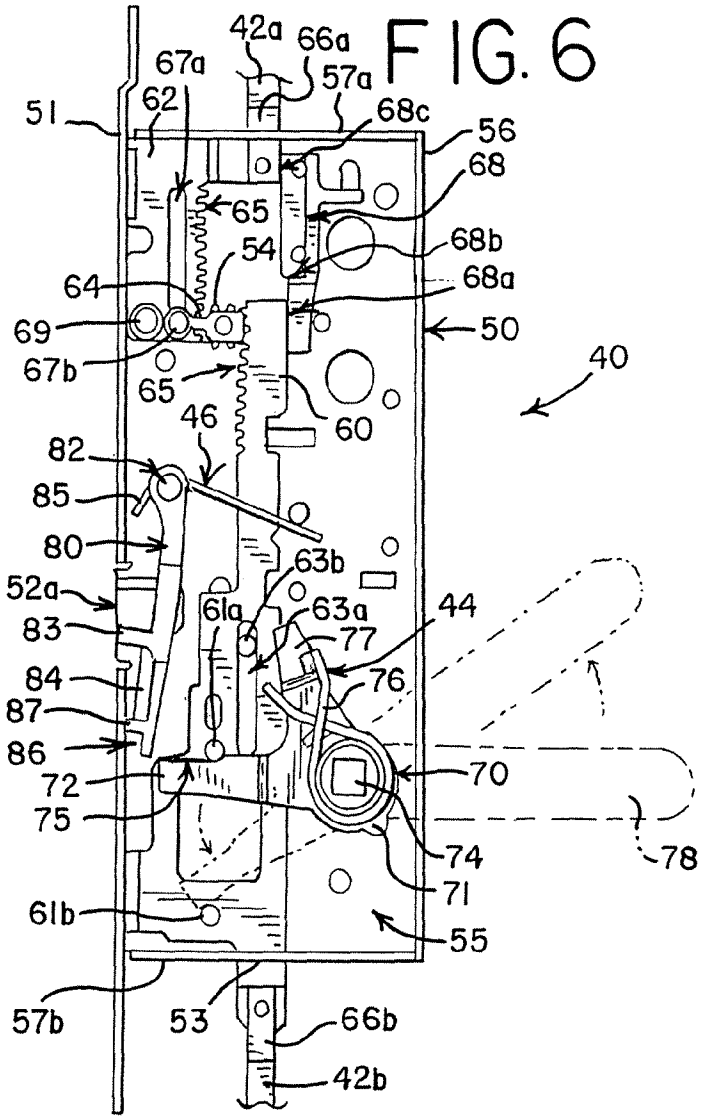
FIG. 6 is a front elevation view of the passive lock assembly of FIG. 4 in a movable configuration.

The stop member 80 also includes a second biasing means 46 coupled to the stop 80 member to bias the stop member 80 toward the second position (FIG. 6). The biasing means 46 includes a spring member 85 wrapped around the pivoting pin at the fixed end 82 of the stop member 80 and is connected to the stop member 80 to bias the stop member 80. The second biasing means 46 may have any other suitable configuration, such as a differently-configured spring or another type of spring.

As shown in FIGS. 4-7, the housing 50 forms the base for the assembled passive lock 40. The retraction members 60,62 are slidably mounted within the housing 50, as described above, so that the connectors 66 can extend out of the shoot bolt apertures 53. The sprocket 54 is rotatably mounted within the housing 50, in engagement with the toothed portions 65 of the retraction members 60,62, and the retainer 64 is mounted to hold the sprocket 54 and the retraction members 60,62 in place. The actuator 70 is pivotably mounted within the housing 50 as described above, holding the first retraction member 60 in place. The stop member 80 is also pivotably mounted within the housing 50 as described above. The biasing means 44,46 are connected to the actuator 70 and the stop member 80 respectively. Once all the internal components of the passive lock 40 are mounted within the housing 50, the removable side wall 55 (shown on the housing 50 in FIGS. 2 and 5) is fastened to the housing 50, preferably by nut and bolt connections, sealing the housing 50. The housing 50 is then mounted within a cavity in the passive door 16 via the fastener holes in the face plate 51. The threaded shoot bolts 42 are connected to the connectors 66 and also mounted within the passive door 16. The handle 78 is then inserted through the aperture 74 in the actuator 70. The active lock 30 is mounted within a cavity in the active door 14, such that the latch bolt 32 and the dead bolt 36 are on a face of the active door 14 opposing the face plate 51 of the passive lock 40 when the doors 14,16 are closed.

In operation, when the passive door 16 is in the closed position, the passive lock has three general configurations: a locked configuration, a movable configuration, and an unlocked configuration. In the locked configuration, the shoot bolts 42 are in the extended positions, wherein the ends of the shoot bolts 42 engage the receivers 20 and are received within the receivers 20, locking the passive door 16 in the closed position, as shown in FIG. 2. The retraction members 60,62 are also positioned accordingly to extend the shoot bolts 42, as shown in FIG. 4. The actuator 70 is generally in the central position, due to the force of the first biasing means 44. The latch bolt 32 is received in the latch bolt aperture 52*a*, locking the active door 14 to the passive door 16 and engaging the engagement member 83 of the stop member 80, moving the stop member 80 to the first position. In the first position, the stop member 80 engages the engagement surface 75 of the actuator arm 72, obstructing movement of the actuator 70 and preventing movement of the shoot bolts 42 to the retracted positions. In the engagement between the stop member 80 and the engagement surface 75, the stop member 80 is substantially normal to the engagement surface 75. Optionally, the dead bolt 36 may also be received in the dead bolt aperture 52*b*, more securely locking the active door 14 to the passive door 16 and engaging the bumper 69 of the second retraction member 62, obstructing movement of the second retraction member 62 and preventing movement of the shoot bolts 42 to the retracted positions. Thus, the passive door 16 is locked in place within the door frame 18, the active door 14 is locked to the passive door 16, and the handle 78 cannot be moved to unlock the passive lock 40.

In the movable configuration, shown in FIG. 6, the latch bolt 32 has been withdrawn from the latch bolt aperture 52*a* (such as by unlocking and opening the active door 14), allowing the force of the second biasing means 46 to move the stop member 80 to the second position, where the stop member 80 does not obstruct movement of the actuator 70. It is understood that the dead bolt 36 is also withdrawn. Thus, in the movable configuration, the actuator 70 can be rotated or pivoted by operation of the handle 78 by a user. The unlocked configuration of the passive lock assembly 40 is shown in FIG. 7 and with reference to FIG. 2. Operation of the handle 78 and pivoting of the actuator 70 causes the actuator arm 72 to engage one of the engagement pins 61*a* of the first retraction member 60, moving the first retraction member 60 in the retracting direction and retracting the shoot bolt 42*b*. In the view shown in FIGS. 4 and 6-7, the handle 78 and actuator 70 are rotated clockwise to retract the shoot bolts 42. Simultaneously, the toothed portion 65 of the first retraction member 60 engages the sprocket 54, rotating the sprocket 54. The sprocket 54 engages the toothed portion 65 of the second retraction member 62, moving the second retraction member 52 in the retracting direction and retracting the shoot bolt 42*a*. Once the shoot bolts 42 have been retracted from the receivers 20 in the door frame 18, the passive lock 40 is in the unlocked configuration, and the passive door 16 can swing freely within the door frame 18 between the open and closed positions. Thus, the passive door 16 cannot be opened until either the latch bolt 32 of the active door 14 is retracted or the active door 14 is open, so that the latch bolt 32 is not received in the housing 50. In one preferred embodiment, the latch bolt 32 is automatically disengaged from the stop member 80 when the active door 14 is opened. It is understood that the latch bolt 32 could be designed having a mechanism for positive disengagement from the stop member 80 even when the active door 14 is in the closed position. After movement to the unlocked configuration, the user can release the handle 78, and the first biasing means 44 moves the actuator 70 back to the central position.

When the user desires to lock the doors 14,16 again, the passive door 16 is first moved to the closed position. The handle 78 is then rotated in the opposite direction as described above (counterclockwise, as shown in FIG. 6), causing the actuator arm 72 to engage the other of the engagement pins 61*b*, moving the first retraction member 60 in the extending direction and extending the shoot bolt 42*b*. Simultaneously, the toothed portion 65 of the first retraction member 60 engages the sprocket 54, rotating the sprocket 54. The sprocket 54 engages the toothed surface 65 of the second retraction member 62, moving the second retraction member 62 in the extending direction and extending the shoot bolt 42*a*. Once the shoot bolts 42 are received in the receivers 20, the passive door 16 is locked in the closed position. At this point, the stop member 80 is still in the second position, and the passive lock 40 is still in the movable configuration. When the active door 14 is closed and the latch bolt 32 is received in the latch bolt aperture 52*a*, the latch bolt 32 engages the stop member 80, moving the stop member 80 to the first position. The stop member 80 obstructs movement of the actuator 70 to retract the shoot bolts 42, and thus, the passive lock 40 is returned to the locked configuration. Accordingly, the latch bolt 32 must be disengaged from the stop member 80 before the shoot bolts 42 can be retracted. Thus, a user cannot unlock the passive door 16 until the active door 14 is opened.

It is understood that the features of the passive lock 40 could be incorporated into an active lock assembly as well. Additionally, the passive lock 40 and active lock 30 described above can be used with a sliding door assembly or other type of door assembly, and is not limited for use with swinging door assemblies. The features of the passive lock 40 of the present invention may be adapted to fit a passive lock assembly having face-mounted shoot bolts, such as that shown in U.S. Patent Application Publication No. 2005/0166647, which is incorporated herein by reference, and the embodiment 240 shown in FIG. 11.

Figure 11:
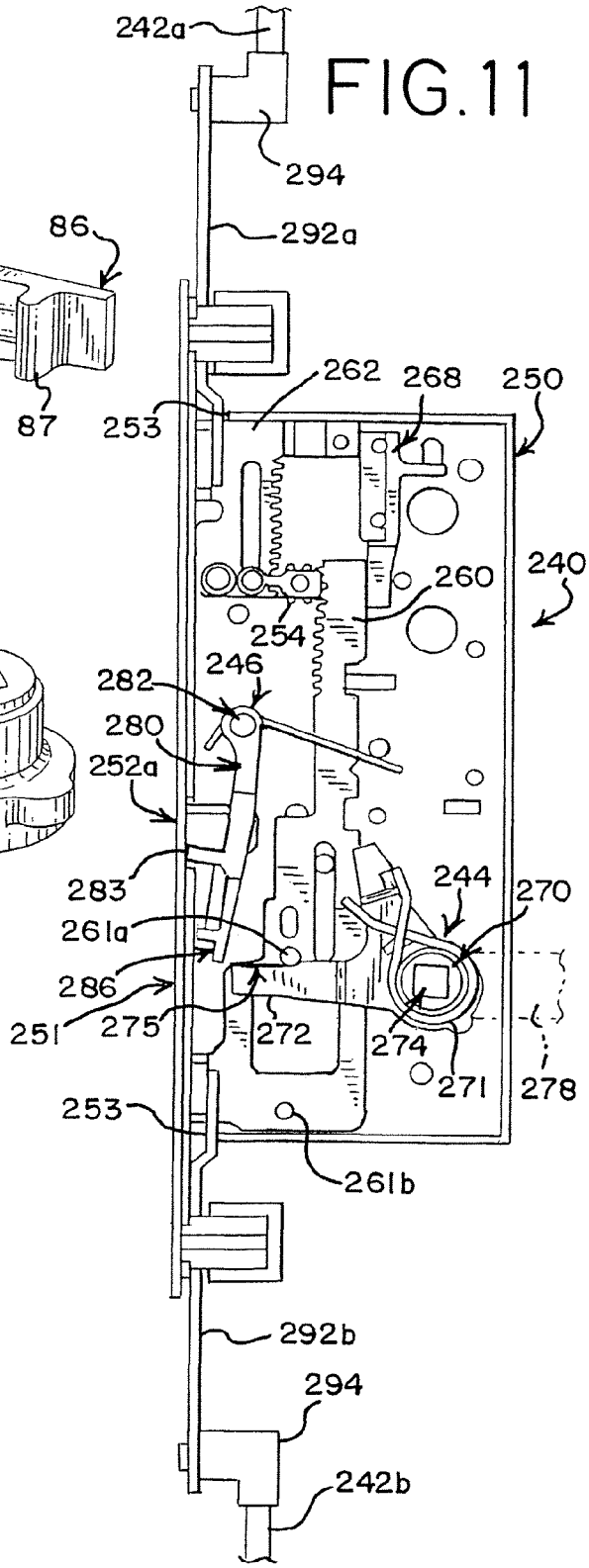
FIG. 11 is a front elevation view of another embodiment of a passive lock assembly of the present invention in a movable configuration.

Most features of the passive lock 240 shown in FIG. 11 are the same as those of the passive lock 40 described above, and are indicated using the "200" series of reference numerals. However, the passive lock 240 shown in FIG. 11 has some differences from the passive lock 40 described above. One such difference is that the shoot bolts 242 are mounted on arms 292 extending from the housing 250 proximate the face plate 251 and the face 24 of the passive door 16. The retraction members 260,262 are connected to the arms 292, which are connected to adapters 294, and the adapters 294 are connected to the shoot bolts 242 via threaded connections. The shoot bolts 242 are extended and retracted by the retraction members 260,262 moving to extend or retract the arms 292, which move the shoot bolts 242. Thus, the shoot bolts 242 are operably connected to the retraction members 260,262. The adapters 294 offset the shoot bolts 242 slightly away from the face plate 251. Operation of the actuator 270, the stop member 280, and the retraction members 260,262 are similar to the same components described above.

Figure 3:
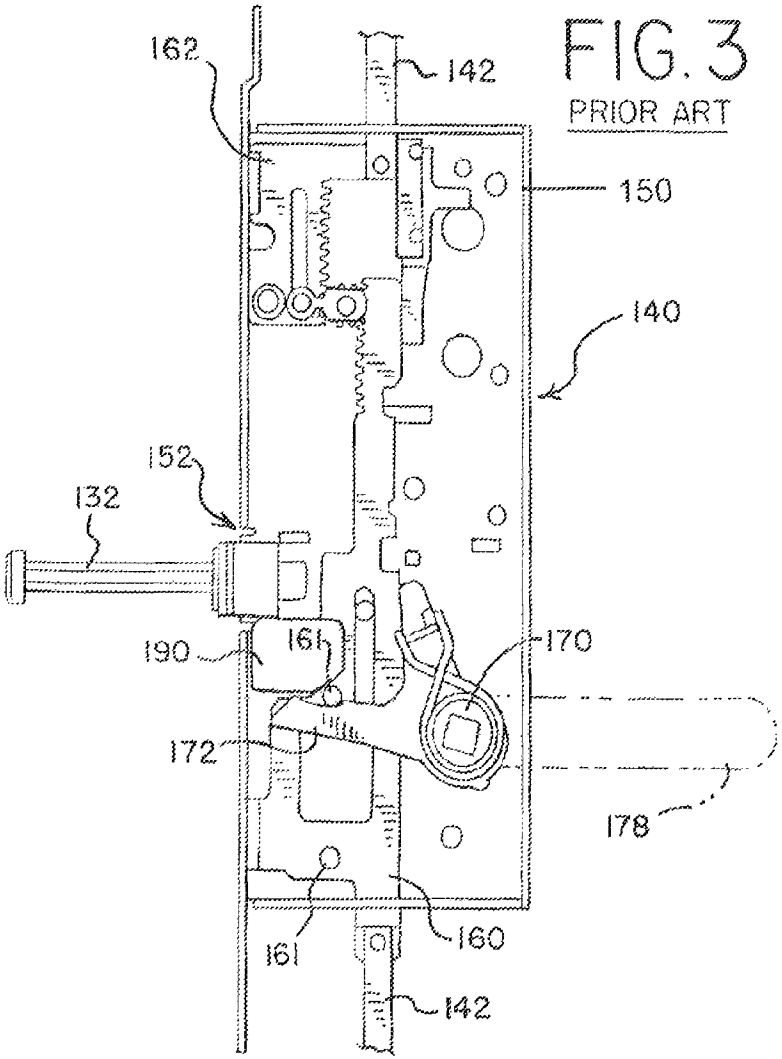
FIG. 3 PRIOR ART
FIG. 3 is a front elevation view of a prior art passive lock assembly in a locked configuration.

A prior art passive lock 140 is illustrated in FIG. 3. Many of the general features of the prior passive lock 140 are similar to those of the passive lock 40 of the present invention. Generally, the prior passive lock 140 includes a housing 150 mounted in a door 16 that contains several components. The housing 150 contains two retraction members 160,162 coupled to shoot bolts 142 for locking the door 16 to a door frame 18. The actuator 170 of the prior passive lock 140 has an arm 172 that engages one of the retraction members 160 via two engagement pins 161 in order to extend and retract the shoot bolts 142. However, the prior actuator arm 172 does not have an offset portion, and is substantially thinner than the arm 72 of the passive lock 40 of the present invention. The prior passive lock 140 has a blocker or blocking member 190 in place of a stop member as described above. The blocker 190 is affixed to the moveable retraction member 160 and abuts the latch bolt 132 to prevent the retraction member 160 from moving to retract the shoot bolts 142. Thus, when the actuator 170 is acted upon with a force to retract the shoot bolts 142, the blocker 190 exerts direct force on the latch bolt 132 in planar-to-planar contact. Because of this planar-to-planar contact, if the user wiggles the handle, frictional forces may eventually push the latch bolt 132 out of the housing 150 and allow the mechanism to slip, retracting the shoot bolts 142 and making a loud noise. This is particularly problematic when the doors 14,16 are installed with too large a gap between them, and the latch bolt 132 extends only a small distance into the housing 150. In this arrangement, the block 190 can easily work its way around the latch bolt 132, due in part to the rounded corners of the block 190. Thus, users unfamiliar with the functionality of the passive door 16 are able to disengage and open the passive door 16 before the active door. Additionally, when the retraction member 160 moves to retract the shoot bolts 142, the blacker 190 moves in front of the latch bolt aperture 152 in the housing 150, blocking the aperture 152. This is undesirable as other components of the active door 14 may still be engaged with the passive door 16, causing damage to the doors 14,16.

The passive lock 40 provides many advantages over prior lock assemblies, including the passive lock 140 illustrated in FIG. 3. The substantially normal engagement between the stop member 80 in the first position and the engagement surface 75 of the actuator 70 does much to prevent accidental slippage of the mechanism and retraction of the shoot bolts 42. Due to the substantially normal engagement, the force exerted by the actuator 70 on the stop member 80 extends down the length of the stop member 80 and does not transfer to the latch bolt 32. In fact, in the embodiment shown in FIGS. 4 and 6-7, the actuator arm 72 is moving slightly to the right during clockwise rotation, and thus exerts a slight rightward force on the stop member 80, tending to lock the stop member 80 in the first position rather than forcing the stop member 80 to the second position. The passive lock 40 of the present invention can withstand upwards of 500 in.·lbs. of torque. In contrast, in the passive lock 140 of FIG. 3, the blocking member 190 exerts force directly on the latch bolt 132, which may force the latch bolt 132 out of the housing 150 and allow accidental slippage of the passive lock 140 and retraction of the shoot bolts 142.

Additionally, the stop member 80 can move to securely obstruct the actuator arm 72 with only a small amount of movement of the engagement member 83, because the lever action of the stop member 80 allows a small movement of the engagement member 83 to move the free end of the stop member 80 a greater distance. Also, because the engagement member 83 extends away from the body of the stop member 80 toward the edge of the housing 50 at the latch bolt aperture 52*a*, any intrusion of the latch bolt 32 into the housing 50 will engage the engagement member and cause movement of the stop member 80. Thus, the passive lock 40 guards against gap variances between the doors 14,16, and will prevent retraction of the shoot bolts 42 even when the doors 14,16 are mounted with too large a gap between them.

Further, as illustrated in FIG. 4, in the first position, the stop member 80 only obstructs movement of the actuator 70, and does not obstruct independent movement of the first retraction member 60. Thus, the latch bolt 32 can be received in the housing 50, locking the doors 14,16 together when the shoot bolts 42 are in the retracted positions. Further, the actuator 70 can be moved to extend the shoot bolts 42, as the stop member 80 preferably only obstructs movement of the actuator 70 to retract the shoot bolts 42. This is not possible in the passive lock 140 of FIG. 3, because the blocking member 190 moves with the first retraction member 160 and obstructs the latch bolt aperture 152*a* when the shoot bolts 142 are retracted. The passive lock 40 provides additional advantages over prior art lock assemblies, including the passive lock 140 shown in FIG. 3, which are apparent to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "upper," "lower," "top," "bottom," "left," "right," "clockwise," "counterclockwise," etc., as used herein, are intended for illustrative purposes only and do not limit the embodiments in any way. Accordingly, while the specific embodiments have been illustrated and described, numerous modifications come to mind without significantly departing from the spirit of the invention and the scope of protection is only limited by the scope of the accompanying claims.

What is claimed is:

1. A passive lock assembly for use with a door mounted to a door frame and moveable between an open position and a closed position, the passive lock assembly comprising:

a housing adapted to be mounted on the door, the housing including a face plate having an active bolt opening;

a first bolt extending from the housing and moveable between an extended position, wherein the first bolt is adapted to engage the door frame to lock the door in the closed position, and a retracted position, wherein the first bolt is adapted to retract from the door frame to permit the door to move to the open position;

an actuator supported by the housing and operably connected to the first bolt, the actuator being moveable to move the first bolt between the extended position and the retracted position, the actuator having an engagement surface; and a stop member pivotably connected to the housing and pivotable between a first position, wherein the stop member engages the engagement surface of the actuator to obstruct movement of the actuator and prevent movement of the first bolt to the retracted position, and a second position, wherein the stop member does not obstruct movement of the actuator, and wherein the stop member is repositionable from the second position to the first position when contacted by a portion of an active lock assembly extending through the active bolt opening of the face plate.

2. The passive lock assembly of claim 1, wherein the stop member is elongated along an axis substantially normal to the engagement surface of the actuator.

3. The passive lock assembly of claim 2, wherein the stop member has an engagement member extending substantially normal to the axis of elongation of the stop member, the engagement member adapted to be engaged by a latch bolt extending into the housing to move the stop member from the second position to the first position.

4. The passive lock assembly of claim 1, wherein the stop member is substantially normal to the engagement surface in the first position.

5. The passive lock assembly of claim 1, wherein the stop member has first and second opposed ends and is pivotably connected to the housing at the first end and engages the actuator at the second end.

6. The passive lock assembly of claim 1, wherein the actuator is pivotably connected to the housing, and the passive lock assembly further comprises a handle connected to the actuator, the handle adapted to be manipulated by a user to pivotably move the actuator.

7. The passive lock assembly of claim 1, wherein the stop member is adapted to be engaged by a latch bolt extending into the housing to move the stop member from the second position to the first position.

8. The passive lock assembly of claim 1, further comprising:

means for biasing the stop member to the second position; and means for biasing the actuator toward a central position.

9. The passive lock assembly of claim 1, further comprising a retraction member supported by the housing and operably connected to the first bolt for moving the first bolt between the extended position and the retracted position, wherein the actuator engages the retraction member to move the first bolt.

10. The passive lock assembly of claim 1, further comprising:

a second bolt extending from the housing in a direction opposite the direction of the first bolt and moveable between an extended position, wherein the second bolt is adapted to engage the door frame, on a side of the door frame opposite the first bolt, to lock the door in the closed position, and a retracted position, wherein the second bolt is adapted to retract from the door frame to permit the door to move to the open position, wherein the actuator is operably connected to the second bolt, the actuator being moveable to move the first bolt and the second bolt simultaneously between the extended positions and the retracted positions.

11. The passive lock assembly of claim 10, further comprising:

a first retraction member supported by the housing and operably connected to the first bolt for moving the first bolt between the extended position and the retracted position; and a second retraction member supported by the housing and operably connected to the second bolt for moving the second bolt between the extended position and the retracted position, wherein the actuator engages the first retraction member to move the first bolt and the first retraction member is operably connected to the second retraction member to move the second bolt.

12. The passive lock assembly of claim 1, wherein the actuator comprises a body and an arm extending from the body, the arm having an offset portion, and the engagement surface is located on the offset portion of the arm.

13. The passive lock assembly of claim 1, further comprising a receiver adapted to be mounted on the door frame, wherein the first bolt engages the receiver in the extended position and the first bolt retracts from the receiver in the retracted position.

14. A passive lock assembly for use with a door mounted to a door frame and moveable between an open position and a closed position, the passive lock assembly comprising:

a housing adapted to be mounted on the door, the housing including a face plate having an active bolt opening that provides a horizontal line of travel extending into the housing;

a receiver adapted to be mounted on the door frame;

a bolt extending from the housing and moveable between an extended position, wherein the bolt engages the receiver to lock the door in the closed position, and a retracted position, wherein the bolt retracts from the receiver to permit the door to move to the open position;

an actuator supported by the housing and operably connected to the bolt, the actuator being moveable to move the bolt between the extended position and the retracted position, the actuator having an engagement surface; and a stop member supported by the housing and moveable between a first position, wherein the stop member engages the engagement surface of the actuator to obstruct movement of the actuator and prevent movement of the bolt to the retracted position, and a second position, wherein the stop member does not obstruct movement of the actuator, wherein at least a portion of the stop member is accessible through the active bolt opening and lies along the horizontal line of travel.

15. The passive lock assembly of claim 14, wherein the stop member is pivotably connected to the housing and pivotable between the first position and the second position.

16. The passive lock assembly of claim 15, wherein the stop member has first and second opposed ends and is pivotably connected to the housing at the first end and engages the actuator at the second end.

17. The passive lock assembly of claim 16, wherein the stop member is tapered inward proximate the second end.

18. The passive lock assembly of claim 14, wherein the actuator comprises a body and an arm extending from the body, the arm having an offset portion, and the engagement surface is located on the offset portion of the arm.

19. A door assembly comprising:

a door frame;

an active door mounted within the door frame and moveable between an open position and a closed position;

a passive door mounted within the door frame in side-by-side relation with the active door and moveable between an open position and a closed position;

an active lock mounted within the active door, the active lock comprising a latch bolt moveable between an extended position and a retracted position, and a first handle operably coupled to the latch bolt to move the latch bolt between the extended position and the retracted position;

a receiver mounted in the door frame; and a passive lock assembly comprising:

a housing mounted within the passive door, the housing having a face plate having an aperture therein;

a shoot bolt extending from the housing and moveable between an extended position, wherein the shoot bolt engages the receiver to lock the passive door in the closed position, and a retracted position, where the bolt retracts from the receiver to permit the passive door to move to the open position;

a retraction member supported by the housing and operably connected to the shoot bolt for moving the shoot bolt between the extended position and the retracted position;

an actuator supported by the housing and operably connected to the retraction member, the actuator being moveable to move the shoot bolt between the extended position and the retracted position, the actuator having an engagement surface;

a handle coupled to the actuator and adapted to be manipulated by a user to move the actuator;

a first spring member coupled to the actuator to bias the actuator to a central position;

a pivotable stop member pivotably connected to the housing and pivotable between a first position, wherein the stop member engages the engagement surface of the actuator to obstruct movement of the actuator and prevent movement of the shoot bolt to the retracted position and wherein the stop member is substantially normal to the engagement surface, and a second position, wherein the stop member does not obstruct movement of the actuator; and a second spring member coupled to the stop member to bias the stop member toward the second position, wherein when the active door and the passive door are in the closed positions and the latch bolt is in the extended position, the latch bolt extends into the housing and engages the stop member to move the stop member from the second position to the first position.

20. The passive lock assembly of claim 19, wherein the stop member is elongated along an axis substantially normal to the engagement surface of the actuator.

21. The passive lock assembly of claim 20, wherein the stop member has an engagement member extending substantially normal to the axis of elongation of the stop member, wherein the latch bolt engages the engagement member to move the stop member from the second position to the first position.

* * * * *